United States Patent [19]

Pozzobon

[11] 4,372,061

[45] Feb. 8, 1983

[54] DEVICE FOR ADJUSTING THE FLEXIBILITY OF A SKI BOOT OR THE LIKE ARTICLE

[75] Inventor: Alessandro Pozzobon, Treviso, Italy

[73] Assignee: Nordica S.p.A., Montebelluna, Italy

[21] Appl. No.: 260,153

[22] Filed: May 4, 1981

[30] Foreign Application Priority Data

May 23, 1980 [IT] Italy ..... 21895 B/80

[51] Int. Cl.[3] ..... A43B 5/04

[52] U.S. Cl. ..... 36/117; 36/50

[58] Field of Search ..... 36/117, 119, 50, 52, 36/53; D2/405; 24/221 R, 221 A; 403/348, 353; 248/499, 503.1

[56] References Cited

U.S. PATENT DOCUMENTS

| | | | |
|---|---|---|---|
| 2,931,471 | 5/1960 | Howard | 24/221 R |
| 3,878,589 | 4/1975 | Schaefer | 248/225.1 |
| 3,969,833 | 6/1976 | Vaccari | 36/117 |
| 4,178,656 | 12/1979 | MacFarlane | 24/221 R |
| 4,182,056 | 1/1980 | Dalebout | 36/117 |

*Primary Examiner*—Werner H. Schroeder
*Assistant Examiner*—Steve Meyers
*Attorney, Agent, or Firm*—Guido Modiano; Albert Josif

[57] ABSTRACT

For adjusting the flexibility of a ski boot, at the top free end of the ski boot shell there are provided a longitudinally extending cut the edges whereof are formed with a plurality of oppositely located pairs of notches, and a stiffening member effective to be removably inserted through one notch pair and preset to adjust the degree of flexibility of the boot shell.

4 Claims, 3 Drawing Figures

DEVICE FOR ADJUSTING THE FLEXIBILITY OF A SKI BOOT OR THE LIKE ARTICLE

BACKGROUND OF THE INVENTION

This invention relates to a device for adjusting the flexibility of a ski boot or the like article.

As is known, there is formed at the top end of the shell of a ski boot made of a plastics material a cut whose edges are held together by straps or crosspieces which span the gap transversely and in practice will stiffen the region of the boot affected to create a very rigid footwear structure.

Where the user wishes to have more flexibility in his/her ski boots, he/she will remove the crosspieces, thereby the cut edges can be brought closer to each other and provide a degree of flexibility in the boots.

In a prior patent application (Italian Application No. 22,142 B/79, filed on July 19, 1979 by the same Assignee), an insert is disclosed which can be inserted in the cut whenever the original stiffness condition is to be restored, that is the condition provided by the crosspieces.

While the above approach has proved acceptable in principle, it has the important drawback that the amount of flexibility cannot be adjusted at will, since it only affords a boot having maximum flexibility or alternatively being completely rigid.

SUMMARY OF THE INVENTION

This invention sets out to eliminate the limitations just described by providing a device which enable the flexibility of a ski boot to be adjusted gradually to meet varying contingent requirements of the user.

Within the above general aim, it is possible to arrange that the device according to this invention, for adjusting the flexibility of a ski boot, is structurally quite simple, highly versatile in application, and convenient to use by any skier.

It is further possible to arrange that this device for adjusting the flexibility of a ski boot is most reliable and safe in operation.

According to one aspect of the present invention, there is provided in a ski boot or the like a device for adjusting the flexibility thereof, comprising at least one longitudinally extending cut provided at the top free end of the shell of the ski boot, characterized in that it further comprises, formed in the edges of said cut, a plurality of oppositely located pairs of notches, there being further provided a stiffening member adapted for removable insertion through one of said notch pairs and preset to adjust the degree of flexibility in said ski boot shell.

BRIEF DESCRIPTION OF THE DRAWING

Further features and advantages will be more readily apparent from a detailed description of a device for adjusting the flexibility of a ski boot or the like article, according to this invention, with reference to the accompanying illustrative and not limitative drawing, where.

DESCRIPTION OF THE PREFERRED EMBODIMENTS

Figure 2:
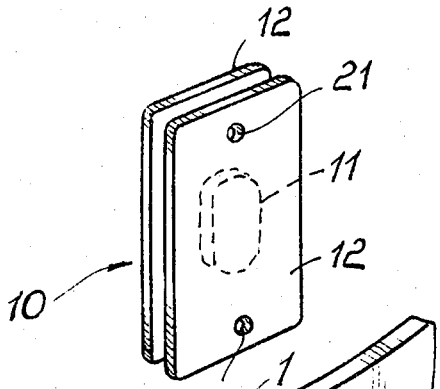
FIG. 2 is a perspective view of the stiffening member.
Figure 3:
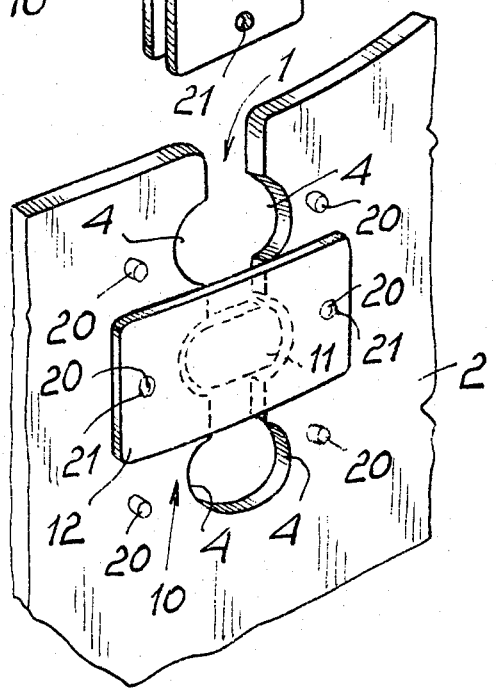
FIG. 3 is a perspective view of the cut with the stiffening member applied thereto.
Figure 1:
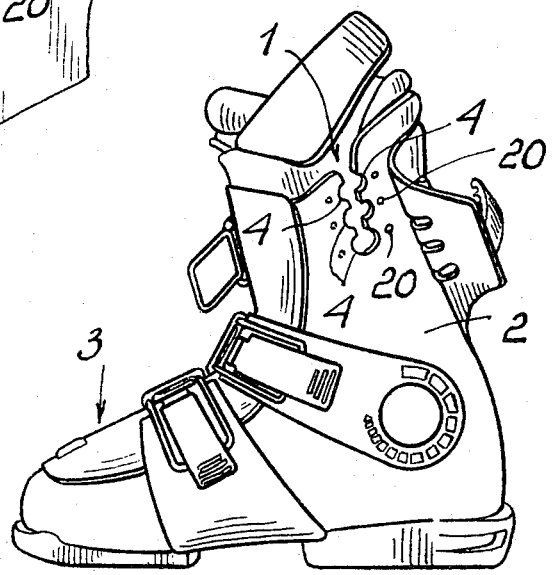
FIG. 1 shows a ski boot formed with said cut at the top or upper end of the shell.

With reference to the drawing figures, the device for adjusting the flexibility of a ski boot comprises, in accordance with this invention, at least one longitudinally extending cut 1, and preferably one pair of oppositely located cuts, which will be formed at the top free edge of the shell 2 of a ski boot, generally indicated at 3.

A peculiar feature of the invention resides in that, formed in the edge portions of said cut 1, there are provided a plurality of pairs of notches 4, arranged opposite each other and preferably, though not necessarily, shaped as arcs of a circle.

In one pair of notches, a stiffening member, generally indicated at 10, can be removably inserted, said member advantageously comprising a flattened body having a central core 11, to the ends whereof are attached plate-like elements 12.

Advantageously, the central core 11 has, when viewed in cross section, an elongate oval shape, thereby it exhibits a transverse dimension which is substantially equal to or smaller than the cut width, and a longitudinal dimension which is larger than the width of said cut and substantially matches the configuration of said notches 4.

Moreover, at each notch pair, there are provided on the shell 2 pins 20 adapted for press-fit insertion in through holes 21 formed in the plate-like element 12 which is located on the outside, thereby the stiffening member can be removably secured in a desired position.

The operation and use of the device according to the invention will be apparent from the foregoing description. The user will in fact insert the stiffening member 10 in any one pair of notches 4, thus changing the useful or working depth of the cut.

It will be appreciated, in fact, that in the instance where the stiffening member is set in the uppermost pair of notches, it will practically bring the shell to a condition of absolute stiffness or rigidity, thus preventing it from flexing, whereas by inserting it in the lowermost notch pair, the shell enjoys a maximum of flexure.

Of course, it will be possible to provide intermediate pairs of notches, such that the amount of flexibility can be graduated at will.

For inserting the stiffening member, the latter is first positioned vertically as shown in FIG. 2, and then pushed into the cut utilizing the fact that its central core is of a smaller size than or of equal size to the cut width, such that it can be pushed in to the desired depth.

Once the selected position has been established, the stiffening member is rotated through 90° to insert the core into one pair of notches 4, wherein it is held in place owing to the pins 20 penetrating the corresponding holes 21.

The plate-like elements 12 are practically arranged astride the edges of the cut, such that the stiffening member can be securely coupled and held in position.

It will be apparent from the foregoing description that the invention achieves its objects, and in particular, it should be noted that this device for adjusting the flexibility of a ski boot or the like article, is extremely simple, while on account of the stiffening member being at all times inserted in one of the selected notch pairs, it cannot be lost by the user.

In practicing the invention, the materials used, and the dimensions and contingent shapes can be any ones, depending on individual requirements.

I claim:

1. In a ski boot or the like, a device for adjusting the flexibility thereof, comprising at least one longitudinally extending cut provided at the top free end of the shell of the ski boot, characterized in that it further comprises, formed in the edges of said cut, a plurality of oppositely located pairs of notches, there being further provided a stiffening member adapted for removable insertion through one of said notch pairs and preset to adjust the degree of flexibility in said ski boot shell.

2. A device according to claim 1, characterized in that said notches are in the shape of arcs of a circle.

3. A device according to claim 1, characterized in that said stiffening member comprises a body having a central core to the ends whereof are attached plate-like elements positionable astride the edges of said cut, said central core having a substantially elongate oval configuration with a width dimension smaller than or equal to the width dimension of said cut and a longitudinal dimension substantially matching the configuration of one of said pairs of notches.

4. A device according to claim 1, characterized in that it comprises, located at each pair of said plurality of pairs of notches, pins protruding from said shell and being adapted for press-fit insertion in corresponding holes formed in one of said plate-like elements of said stiffening member to lock in position said stiffening member.

* * * * *